US008512520B2

(12) United States Patent
Schmid et al.

(10) Patent No.: US 8,512,520 B2
(45) Date of Patent: Aug. 20, 2013

(54) PAPER SIZING AGENT

(75) Inventors: Markus Schmid, Deidesheim (DE); Roland Ettl, Ketsch (DE); Klaus Lorenz, Worms (DE); Rainer Dyllick-Brenzinger, Speyer (DE); Andreas Brockmeyer, Bickenbach (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 590 days.

(21) Appl. No.: 11/720,362

(22) PCT Filed: Nov. 29, 2005

(86) PCT No.: PCT/EP2005/012750

§ 371 (c)(1), (2), (4) Date: May 29, 2007

(87) PCT Pub. No.: WO2006/058711

PCT Pub. Date: Jun. 8, 2006

(65) Prior Publication Data

US 2008/0041546 A1 Feb. 21, 2008

Related U.S. Application Data

(60) Provisional application No. 60/631,171, filed on Nov. 29, 2004.

(51) Int. Cl.

| | |
|---|---|
| ***D21H 17/17*** | (2006.01) |
| ***D21H 17/29*** | (2006.01) |
| ***D21H 17/33*** | (2006.01) |
| ***D21H 17/45*** | (2006.01) |
| ***D21H 21/16*** | (2006.01) |
| ***D21H 21/18*** | (2006.01) |
| ***C08L 3/00*** | (2006.01) |

(52) U.S. Cl.
USPC ..... 162/168.2; 162/158; 162/164.6; 162/166; 162/175; 162/185; 549/201; 549/329; 106/206.1; 106/217.6

(58) Field of Classification Search
USPC ..... 549/201, 203, 233, 329, 205, 235; 162/164.6, 166, 158, 164.1, 168.1–168.2, 162/175, 183, 185; 106/162.1, 206.1, 217.6
See application file for complete search history.

(56) References Cited

U.S. PATENT DOCUMENTS

| | | | | | |
|---|---|---|---|---|---|
| 3,223,544 | A | | 12/1965 | Savina | |
| 4,606,773 | A | * | 8/1986 | Novak | 106/209.1 |
| 4,957,977 | A | * | 9/1990 | Itagaki et al. | 525/328.4 |
| 5,688,886 | A | * | 11/1997 | Noguchi et al. | 526/273 |
| 5,942,588 | A | | 8/1999 | Ettl et al. | |
| 6,001,166 | A | * | 12/1999 | Ettl et al. | 106/287.2 |
| 6,159,339 | A | * | 12/2000 | Hassler et al. | 162/158 |
| 6,315,824 | B1 | * | 11/2001 | Lauzon | 162/158 |
| 6,372,035 | B1 | * | 4/2002 | Juppo et al. | 106/287.2 |
| 2003/0127205 | A1 | * | 7/2003 | Odberg et al. | 106/287.2 |
| 2005/0061461 | A1 | * | 3/2005 | Linhart et al. | 162/158 |
| 2006/0037512 | A1 | * | 2/2006 | Pawlowska et al. | 162/158 |
| 2006/0162883 | A1 | | 7/2006 | Champ et al. | |
| 2007/0167558 | A1 | | 7/2007 | Bonn et al. | |

FOREIGN PATENT DOCUMENTS

| | | | |
|---|---|---|---|
| DE | 10 2004 010 447 | A1 | 9/2005 |
| WO | WO 96/26318 | | 8/1996 |
| WO | WO 98/41565 | | 9/1998 |
| WO | WO-03/052205 | A1 * | 6/2003 |
| WO | WO 2004/022847 | A1 | 3/2004 |

OTHER PUBLICATIONS

"Acyclic diene", Britannica Academic Edition, no date, [retrieved on Jul. 1, 2011], Retrieved from the Internet: <URL: http://www.britannica.com/EBchecked/topic/4778/acyclic-diene>.*

* cited by examiner

*Primary Examiner* — Mark Halpern
*Assistant Examiner* — Dennis Cordray
(74) *Attorney, Agent, or Firm* — Oblon, Spivak, McClelland, Maier & Neustadt, L.L.P.

(57) ABSTRACT

A paper size which comprises a stable aqueous dispersion of a reactive size, from 5 to 100% by weight, based on the reactive size, of a substantially linear nitrogen-comprising polymer having at least 3 mmol/g of basic nitrogen atoms, and from 1 to 50% by weight of cationic starch having a degree of substitution of at least 0.05 is described. The paper size has a good sizing effect and a stable viscosity.

11 Claims, No Drawings

PAPER SIZING AGENT

This application is a 371 of PCT/EP05/12750, filed Nov. 29, 2005 which claims the benefit of U.S. Provisional Application No. 60/631,171, filed Nov. 29, 2004.

The invention relates to a paper size which comprises a stable aqueous dispersion of a reactive size, process for its preparation and its use for sizing paper, board and cardboard.

Reactive sizes, such as alkylketene dimers, are used in large amounts for the engine sizing of paper, board and cardboard. The reactive sizes are commercially available generally as ready-to-use dispersions. They comprise, as a rule, cationic polymers, such as cationic starch, or synthetic cationic polymers which impart to the reactive sizes substantivity with respect to cellulose and/or act as protective colloids.

To ensure that the size dispersions are suitable for use, they must have sufficiently stable viscosity so that they remain pumpable and dilutable up to their addition to the paper machine. In practice, the dispersions often have to maintain low viscosity for several weeks at temperatures up to 40° C. These requirements can be met only with difficulty owing to the inherent instability of colloidal systems. Often, the viscosity of the dispersions increases sharply until they can no longer be pumped or the dispersions coagulate. The higher the content of reactive size in the dispersions, the more pronounced are the problems.

U.S. Pat. No. 3,223,544 discloses alkyldiketene (AKD) dispersions comprising cationic starch as a protective colloid and an anionic dispersant as a stabilizer.

WO-A-96/26318 discloses AKD dispersions which comprise a protective colloid in the form of a copolymer of N-vinylpyrrolidone and N-vinylimidazole or a condensate based on polyethyleneimines.

WO 2004/022847 discloses the use of polyvinylamines as promoters for engine sizing in starch-comprising AKD dispersions.

WO-A-98/41565 discloses AKD dispersions which comprise, as a protective colloid, reaction products of amino-comprising polymers consisting of the polymers comprising vinylamine units, polyamidoamines and polyamidoamines grafted with polyethyleneimine with diketenes in the weight ratio of polymer to diketene of from 10 000:1 to 1:3.

The prior German patent application with the application number DE 102004010447.6 discloses the use of polyvinylamines as protective colloids in aqueous dispersions of reactive sizes. The dispersions are to be preferably free of cation starch.

It is an object of the present invention to provide paper sizes based on aqueous dispersions of reactive sizes, which paper sizes have a good sizing effect and a sufficiently stable viscosity.

We have found that this object is achieved, according to the invention, by a paper size which comprises:

(a) a stable aqueous dispersion of a reactive size, (b) from 5 to 100%, preferably from 10 to 100%, in particular from 20 to 50%, by weight, based on the reactive size, of a substantially linear nitrogen-comprising polymer having at least 5 mmol/g of basic nitrogen atoms, (c) from 1 to 50%, preferably from 3 to 25%, in particular from 10 to 20%, by weight, based on the reactive size, of cationic starch having a degree of substitution of at least 0.05, preferably from 0.05 to 0.5, in particular from 0.08 to 0.3, most preferably from 0.1 to 0.2.

Usually, the novel paper sizes comprise from 1 to 50% by weight, based on the total weight of the paper size, of reactive size.

The term "stable dispersion" is intended to mean that the dispersion remains fluid on storage for over 4 weeks at 40° C. and does not coagulate.

"Linear polymer" is understood as meaning a polymer which is substantially free of branches and crosslinks. Polyalkyleneimines, in particular polyethyleneimines, are not regarded as "linear polymers" owing to their structure branched by tertiary amino groups.

"Basic nitrogen atoms" are understood as meaning those nitrogen atoms which can be protonated in aqueous solution by a Brönsted acid. Basic nitrogen atoms are in particular primary, secondary and tertiary amino groups, of which primary amino groups are preferred. The basic nitrogen atoms in the nitrogen-comprising polymer are preferably protonated to at least 90 mol %, in particular substantially quantitatively. The protonation can be effected by reaction with a mineral acid, such as hydrochloric acid, sulfuric acid or phosphoric acid, but is preferably effected by reaction with a carboxylic acid. Suitable carboxylic acids are in particular formic acid, acetic acid, propionic acid, oxalic acid, tartaric acid, citric acid and the like. A substantially quantitative protonation protonation is obtained if the nitrogen-comprising polymer is brought to a pH of less than 5 with the total acid.

The nitrogen-comprising polymer used according to the invention comprises at least 3 mmol/g, preferably at least 5 mmol/g, particularly preferably from 7.5 to 23 mmol/g, most preferably from 12 to 18 mmol/g, of basic nitrogen atoms. The content ρ of basic nitrogen atoms in a polymer can be calculated according to the following equation:

$$\rho = x_N/(x_N M_N + x_o M_o)$$

where $x_N$ is the molar fraction of a monomer having a basic nitrogen atom (such as vinylamine), $x_o$ is the molar fraction of a monomer without (basic) nitrogen atoms (such as vinylformamide), $M_N$ is the molecular weight of the monomer having a basic nitrogen atom and $M_o$ is the molecular weight of the monomer without (basic) nitrogen atoms. The term "molar fraction" relates here to the monomer composition of the polymer.

The average molecular weight Mw of the nitrogen-comprising polymer is, for example, from 500 to 10 million, preferably from 750 to 5 million, particularly preferably from 1000 to 2 million (determined by light scattering). This molar mass range corresponds, for example, to K values of from 30 to 150, preferably from 60 to 90 (determined according to H. Fikentscher in 5% strength sodium chloride solution at 25° C., a pH of 7 and a polymer concentration of 0.5% by weight).

The suitable nitrogen-comprising polymers include hydrolysis products of homo- and copolymers of N-vinylcarboxamides and/or N-vinylcarboximides. In the hydrolysis, acyl group(s) is or are eliminated from some or all of the polymerized N-vinylcarboxamide or N-vinylcarboximide units by the action of acids, bases or enzymes with formation of vinylamine units.

Suitable N-vinylcarboxamides are in principle open-chain and cyclic N-vinylcarboxamides. Preferred N-vinylcarboxamides are open-chain N-vinylcarboxamides, in particular those open-chain N-vinylcarboxamides whose hydrolysis gives a primary amine. Examples of particularly suitable N-vinylcarboxamides are N-vinylformamide, N-vinyl-N-methylformamide, N-vinylacetamide, N-vinyl-N-methylacetamide, N-vinyl-N-ethylacetamide and N-vinylpropionamide, in particular N-vinylformamide. Examples of suitable N-vinyl imides are N-vinylsuccinimide and N-vinylphthalimide. Said monomers can be polymerized either alone or as a mixture with one another or together with other monomers.

Polymers comprising vinylamine units are disclosed, for example, in U.S. Pat. No. 4,421,602, U.S. Pat. No. 5,334,287, EP-A-0 216 387, U.S. Pat. No. 5,981,689, WO-A-00/63295 and U.S. Pat. No. 6,121,409.

Suitable monoethylenically unsaturated monomers which are copolymerized with the N-vinylcarboxamides are all compounds copolymerizable therewith. Examples of these are vinyl esters of saturated carboxylic acids of 1 to 6 carbon atoms, such as vinyl formate, vinyl acetate, vinyl propionate and vinyl butyrate, and vinyl ethers, such as $C_1$- to $C_6$-alkyl vinyl ethers, e.g. methyl or ethyl vinyl ether. Further suitable comonomers are esters, amides and nitriles of ethylenically unsaturated $C_3$- to $C_6$-carboxylic acids, for example methyl acrylate, methyl methacrylate, ethyl acrylate and ethyl methacrylate, acrylamide and methacrylamide and acrylonitrile and methacrylonitrile.

Further suitable carboxylic esters are derived from glycols or polyalkylene glycols respectively, in each case only one OH group being esterified, e.g. hydroxyethyl acrylate, hydroxyethyl methacrylate, hydroxypropyl acrylate, hydroxybutyl acrylate, hydroxypropyl methacrylate, hydroxybutyl methacrylate and acrylic monoesters of polyalkylene glycols having a molar mass of from 500 to 10 000.

Further suitable comonomers are amides of ethylenically unsaturated carboxylic acids, such as acrylamide or methacrylamide, and N-alkylmono- and diamides of monoethylenically unsaturated carboxylic acids having alkyl radicals of 1 to 6 carbon atoms, e.g. N-methylacrylamide, N,N-dimethylacrylamide, N-methylmethacrylamide, N-ethylacrylamide, N-propylacrylamide and tert-butylacrylamide.

Other suitable comonomers are N-vinylpyrrolidone, N-vinylcaprolactam, acrylonitrile, methacrylonitrile, N-vinylimidazole and substituted N-vinylimidazoles, e.g. N-vinyl-2-methylimidazole, N-vinyl-4-methylimidazole, N-vinyl-5-ethylimidazole and N-vinyl-2-ethylimidazole, and N-vinylimidazolines, such as N-vinylimidazoline, N-vinyl-2-methylimidazoline and N-vinyl-2-ethylimidazoline.

Such copolymers preferably comprise at least 50 mol % of at least one N-vinylcarboxamide incorporated in the form of polymerized units. The comonomer are preferably free of acid groups.

In order to prepare suitable polyvinylamines, it is preferably to start from N-vinylformamide homopolymers or from N-vinylformamide copolymers, for example with vinyl formate, vinyl acetate, vinyl propionate, acrylonitrile, N-vinylcaprolactam, N-vinylurea, N-vinylpyrrolidone or $C_1$- to $C_6$-alkyl vinyl ethers, the N-vinylformamide units of which are then hydrolyzed up to a degree of hydrolysis of preferably from 25 to 100 mol %, particularly preferably from 50 to 100 mol %, and especially preferably from 70 to 100 mol %, to N-vinylamine units. The hydrolysis of the polymers described above is effected by known methods, by the action of acids, bases or enzymes. With the use of acids as hydrolysis agents, the vinylamine units of the polymers are present in the form of the ammonium salt, whereas the free amino groups form in the hydrolysis with bases.

The vinylamine polymers are preferably used in salt-free form. Salt-free aqueous solutions c an be prepared, for example, from the salt-comprising polymer solutions described above with the aid of ultrafiltration across suitable membranes at cut-offs of, for example, from 1000 to 500 000, preferably from 10 000 to 300 000, Dalton.

Preferred vinylamine polymers are vinylamine homopolymers having a degree of hydrolysis of from 25 to 100 mol %, and copolymers of vinylformamide and vinyl acetate, vinyl alcohol, vinylpyrrolidone or acrylamide, hydrolyzed to a degree of from 25 to 100 mol % and having in each case K values of from 30 to 150, in particular from 60 to 90.

Alternatively, polymers which comprise polymerized units of monomers having side groups comprising basic nitrogen atoms or the copolymers thereof with monomers without (basic) nitrogen atoms can be used in a suitable ratio as the nitrogen-comprising polymer.

Suitable monomers having side groups comprising basic nitrogen atoms are, for example, allylamine, basic acrylates, such as dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate; basic (meth)acrylamides, such as dimethylaminoethyl acrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Suitable monomers without (basic) nitrogen atoms are the abovementioned ones.

The terms "cationic starch" and "cationically modified starch" are used synonymously here. Suitable cationic starches are commercially available. The initial starch may be any desired starch variety, such as potato starch, cornstarch, wheat starch, waxy cornstarch and tapioca starch. Starches having an amylopectin content of more than 50%, preferably from 80 to 100%, by weight are preferred, those having an amylopectin content of at least 90% by weight being particularly preferred.

Protonatable or cationically charged groups, such as in particular dialkylamino or trialkylammonium groups, are coupled to some of the free hydroxyl groups of the starch with the aid of a chemical reaction. Suitable cationizing agents are in particular dialkylaminoalkyl epoxides and dialkylaminoalkyl halides. Instead of the alkyl groups, the cationizing agents may also comprise aryl groups.

Preferred cationizing agents are, for example, N,N-dimethylaminoethyl chloride, N,N-diethylaminoethyl chloride, N,N-dimethylaminopropyl chloride, 3-dibutylamino-1,2-epoxypropane, 2-bromo-5-diethylaminopentane hydrobromide, N-(2,3-epoxypropyl)-piperidine, 2,3-epoxypropyltrimethylammonium chloride and N,N-(2,3-epoxypropyl)-methylaniline. Instead of the free amines, salts of hydrochloric acid or other salts may be used.

The reaction between initial starch and cationizing reagent is preferably carried out in an alkaline medium. The proportion of reagent to be used depends on the desired degree of substitution. The degree of substitution is the ratio of cationic group to carbohydrate unit (i.e. glucose unit). It may assume a maximum value of 3.

Suitable reactive sizes for the novel paper sizes are, for example, $C_{12}$- to $C_{22}$-alkylketene dimers $C_5$- to $C_{22}$-alkyl- or 5- to $C_{22}$-alkenylsuccinic anhydrides, $C_{12}$- to $C_{36}$-alkyl isocyanates and/or organic isocyanates, such as dodecyl isocyanate, octadecyl isocyanate, tetradecyl isocyanate, hexadecyl isocyanate, eicosyl isocyanate and decyl isocyanate. Preferably used engine sizes are alkylketene dimers and long-chain alkyl or alkenylsuccinic anhydrides.

Examples of alkylketene dimers are tetradecyldiketene, stearyldiketene, lauryldiketene, palmityldiketene, oleyldiketene, behenyldiketene or mixtures thereof. Alkyldiketenes having different alkyl groups, such as stearylpalmityldiketene, behenylstearyldiketene, behenyloleyldiketene or palmitylbehenyldiketene, are also suitable. Stearyldiketene, palmityldiketene, behenyldiketene or mixtures of behenyldiketene and stearyldiketene are preferably used. Substituted succinic anhydrides suitable as reactive sizes are, for example, decenylsuccinic anhydride, n-octadecenylsuccinic anhydride, dodecenylsuccinic anhydride and n-hexadecenylsuccinic anhydride.

Usually, the novel aqueous dispersions have a content of from 1 to 50% by weight, based on the total weight of the dispersion, of reactive sizes. For example, the dispersions have a content of from 1 to 50%, preferably from 5 to 35%, by weight, based on the total weight of the dispersion, of $C_{12}$- to $C_{22}$-alkyldiketenes. When $C_5$- to $C_{22}$-alkyl- or $C_5$- to $C_{22}$-alkenylsuccinic anhydrides are used, the content thereof is, for example, from 1 to 25%, preferably from 2 to 10%, by weight, based on the total weight of the dispersion.

In order to stabilize the disperse reactive sizes in the aqueous phase, the novel paper sizes comprise as a rule an anionic dispersant. The content of anionic dispersants in the aqueous dispersion is, for example, from 0.01 to 5%, preferably from 0.01 to 2.5%, very particularly preferably from 0.1 to 1, by weight, based on the reactive size.

Preferred anionic dispersants are selected from condensates of (a) naphthalenesulfonic acid and formaldehyde, (b) phenol, phenolsulfonic acid and formaldehyde, (c) naphthalenesulfonic acid, formaldehyde and urea and (d) phenol, phenolsulfonic acid, formaldehyde and urea.

The anionic dispersants may be present in the form of the free acids, of the alkali metal salts, alkaline earth metal salts and/or the ammonium salts. The ammonium salts may be derived both from ammonia and from primary, secondary and tertiary amines; for example, the ammonium salts of dimethylamine, trimethylamine, hexylamine, cyclohexylamine, dicyclohexylamine, ethanolamine, diethanolamine and triethanolamine are suitable. The condensates described above are known and are commercially available. They are prepared by condensation of said components, it also being possible to use the corresponding alkali metal, alkaline earth metal or ammonium salts instead of the free acids. Suitable catalysts in the condensation are, for example, acids, such as sulfuric acid, p-toluenesulfonic acid and phosphoric acid. Naphthalenesulfonic acids or the alkali metal salts thereof are condensed with formaldehyde, preferably in the molar ratio of from 1:0.1 to 1:2 and generally in the molar ratio of from 1:0.5 to 1:1. The molar ratio for the preparation of condensates of phenol, phenolsulfonic acid and formaldehyde is likewise in the abovementioned range, any desired mixtures of phenol and phenolsulfonic acid being used instead of naphthalenesulfonic acid in the condensation with formaldehyde. Instead of phenolsulfonic acid, it is also possible to use the alkali metal and ammonium salts of phenolsulfonic acid. The condensation of the abovementioned starting materials can, if required, additionally be carried out in the presence of urea. For example, based on naphthalenesulfonic acid or on the mixture of phenol and phenolsulfonic acid, from 0.1 to 5 mol of urea are used per mole of naphthalenesulfonic acid or per mole of the mixture of phenol and phenolsulfonic acid.

The condensates have, for example, molar masses of from 800 to 100 000, preferably from 1000 to 30 000, in particular from 4000 to 25 000. Salts which are obtained, for example, by neutralizing the condensates with lithium hydroxide, sodium hydroxide, potassium hydroxide or ammonia are preferably used as anionic dispersants. The pH of the salt is, for example, from 7 to 10.

Ligninsulfonic acid and the alkali metal, alkaline earth metal or ammonium salts thereof are furthermore suitable as anionic dispersants.

Other suitable anionic dispersants are amphiphilic copolymers of (i) hydrophobic monoethylenically unsaturated monomers and (ii) hydrophilic monomers having an anionic group, such as monoethylenically unsaturated carboxylic acids, monoethylenically unsaturated sulfonic acids, monoethylenically unsaturated phosphonic acids or mixtures thereof.

Suitable hydrophobic monoethylenically unsaturated monomers (a) are, for example, olefins of 2 to 150 carbon atoms, styrene, α-methylstyrene, ethylstyrene, 4-methylstyrene, acrylonitrile, methacrylonitrile, esters of monoethylenically unsaturated $C_3$- to $C_5$-carboxylic acids and monohydric alcohols, amides of acrylic acid or methacrylic acid with $C_1$- to $C_{24}$-alkylamines, vinyl esters of saturated monocarboxylic acids of 2 to 24 carbon atoms, diesters of maleic acid or fumaric acid with monohydric $C_1$- to $C_{24}$-alcohols, vinyl ethers of alcohols of 3 to 24 carbon atoms or mixtures of said compounds.

The amphiphilic copolymers comprise, as hydrophilic monomers (b), for example, monoethylenically unsaturated $C_3$- to $C_{10}$-carboxylic acids or the anhydrides thereof, 2-acrylamido-2-methylpropanesulfonic acid, vinylsulfonic acid, styrenesulfonic acid, vinylphosphonic acid, salts of said monomers or mixtures thereof as hydrophilic monomers having an anionic group, incorporated in the form of polymerized units.

Aqueous size dispersions which comprise, as anionic dispersants, amphiphilic copolymers of (a)α-olefins of 4 to 12 carbon atoms, styrene or mixtures thereof as hydrophobic monomers and (b) maleic acid, acrylic acid, methacrylic acid, monoesters of maleic acid and alcohols of 1 to 25 carbon atoms or alkoxylation products of such alcohols, monoamides of maleic acid, salts of said monomers or mixtures of these compounds as hydrophilic monomers having an anionic group incorporated in the form of polymerized units and have a molar mass Mw of from 1500 to 100 000 are particularly preferred.

Preferred anionic dispersants are copolymers of maleic anhydride with $C_4$- to $C_{12}$-olefins, particularly preferably $C_8$-olefins, such as 1-octene and diisobutene. Diisobutene is very particularly preferred. The molar ratio of maleic anhydride to olefin is, for example, from 0.9:1 to 3:1, preferably from 0.95:1 to 1.5:1. These copolymers are preferably used in hydrolyzed for an aqueous solution or dispersions, the anhydride group being present in open form and some or all of the carboxyl groups preferably being neutralized. The following bases are used for the neutralization, alkali metal bases, such as sodium hydroxide, potassium hydroxide, sodium carbonate or potassium carbonate, alkaline earth metal salts, such as calcium hydroxide, calcium carbonate or magnesium hydroxide, ammonia, primary, secondary or tertiary amines, such as triethylamine, triethanolamine, diethanolamine, ethanolamine, morpholine, etc.

If the amphiphilic copolymers in the form of the free acids are not sufficiently water-soluble, they are used in the form of water-soluble salts; for example, corresponding alkali metal, alkaline earth metal and ammonium salts are used. The molar mass Mw of the amphiphilic copolymer is, for example, from 800 to 250 000, generally from 1000 to 100 000 and preferably from 3000 to 20 000, in particular from 1500 to 10 000.

The acid numbers of the amphiphilic copolymers are, for example, from 50 to 500, preferably from 150 to 300, mg, KOH/g of polymer.

The novel aqueous dispersions may comprise further components, for example non-cellulose-reactive hydrophobic substances which help to improve the stability and are described, for example, in EP-A-437 746 and EP-A-658 228. Suitable non-cellulose-reactive substances are, for example, fatty acids, fatty amides and fatty esters and waxes. Examples of these, without any claim to completeness, are behenyl stearate, stearyl myristate, isododecyl stearate, dioleyl carbonate, oleyl carbonate, oleyl-N,N-distearylurethane, paraffin, diglyceryl oleate, triglyceryl oleate and triglyceryl stearate.

Furthermore, the novel dispersions may additionally comprise finely divided, aqueous polymer dispersions which are a size for paper. Such polymer dispersions are disclosed, for example, in EP-B-0 051 144, EP-B-0 257 412, BP-0 276 770, EP-B-0 058 313 and EP-B-0 150 003. Such polymer dispersions which act as paper sizes are obtainable, for example, by polymerizing 1 to 32 parts by weight of a mixture of (a) styrene, acrylonitrile and/or methacrylonitrile,
(b) acrylates and/or methacrylates of $C_1$- to $C_8$-alcohols and/or vinyl esters of saturated $C_2$- to $C_4$-carboxylic acids and, if required,
(c) other monoethylenically unsaturated copolymerizable monomers in aqueous solution in the presence of 1 part by weight of a solution copolymer as described in WO-A-96/31650 and the literature cited therein.

Suitable monomers of group (a) are styrene, acrylonitrile, methacrylonitrile or mixtures of styrene and acrylonitrile or of styrene and methacrylonitrile. Acrylates and/or methacrylates of $C_1$- to $C_{18}$-alcohols and/or vinyl esters of saturated $C_2$- to $C_4$-carboxylic acids are used as monomers of group (b). Butyl acrylate and butyl methacrylate, e.g. isobutyl acrylate, n-butyl acrylate and isobutyl methacrylate, are preferably used as monomers of group (b). Monomers of group (c) are, for example, butadiene, isoprene, monoethylenically unsaturated $C_3$- to $C_5$-carboxylic acids, acrylamidomethylpropanesulfonic acid, sodium vinylsulfonate, vinylimidazole, N-vinylformamide, acrylamide, methacrylamide, N-vinylmidazoline and cationic polymers, such as dimethylaminopropylmethacrylamide or dimethylaminoethyl acrylate methochloride. From 1 to 32 parts by weight of a monomer mixture comprising the components (a) to (c) are used per 1 part by weight of copolymer. The monomers of components (a) and (b) may be copolymerized in any desired ratio, for example in the molar ratio of from 0.1:1 to 1:0.1. The monomers of group (c) are used, if required, for modifying the properties of the copolymers. Details of the preparation of these additional polymer dispersions are to be found in WO-A-96/31650 and in the literature cited there.

If these polymer dispersions are used in the novel aqueous dispersions of reactive sizes, preferred ones are those which comprise cationic polymers, such as dimethylaminopropylmethacrylamide and/or dimethylaminoethyl acrylate, in combination with styrene, acrylonitrile, butadiene and/or acrylates.

When polymer dispersions such as these are used, the content thereof is, as a rule, from 25 to 300%, preferably from 50 to 250%, and particularly preferably from 75 to 200%, by weight, based on the reactive size.

The present invention further or relates to a process for the preparation of the novel aqueous dispersions of reactive sizes.

For the preparation of size dispersions, the reactive sizes are usually heated to a temperature above their melting point and are emulsified in the molten state in water under the action of shear forces. The liquid alkenylsuccinic anhydride may already have been emulsified at room temperature. By adding lipophilic substances, such as fatty acids, waxes, resin acids and resins, fatty amides or fatty esters, the melting point of the reactive size can, if required, be reduced, with the result that the stability of the dispersion obtained is improved.

For example, an aqueous solution of the cationic starch and of the anionic dispersant may be initially taken, the size and the nitrogen-comprising polymer then added in any desired sequence, and the mixture obtained subjected to a dispersing step. The dispersing step is preferably effected at, for example, from 20 to 100° C., preferably from 40 to 90° C. The size is preferably added in the form of a melt. It has not proven useful initially to Lake the nitrogen-comprising polymer and to add an anionic dispersant in the dispersing step, apparatuses known to the person skilled in the art, for example high-pressure homogenizers, colloid mills and ultrasonic dispersers, are used. The resulting dispersion is cooled in each case.

The novel paper size has a viscosity, for example, of from 20 to 1000 mPa·s, preferably from 100 to 500 mPa·s (measured using a Brookfield viscometer and at a temperature of 22° C.). The viscosity increases on storage for 4 weeks at 40° C., preferably at most to less than twice the value of the initial viscosity immediately after the preparation. In the preparation of the aqueous dispersions, the pH is preferably from 3 to 4. As a rule, aqueous size dispersions having a mean particle size of the size of from 100 to 3000 nm, preferably from 250 to 2000 nm, are obtained.

The novel dispersions are used as engine sizes in the production of paper, board and cardboard. The production of paper, board and cardboard is usually effected by draining a slurry of cellulose fibers. Suitable cellulose fibers are all types customary for this purpose, for example cellulose fibers obtained from wood pulp and fibers obtained all annual plants. Wood pulp includes, for example, groundwood, thermomechanical pulp (TMP), chemothermomechanical pulp (CTMP), pressure groundwood, semichemical pulp, high-yield pulp and refiner mechanical pulp (RMP) and waste paper. Chemical pulps which can be used in bleached or unbleached form are also suitable. Examples of these are sulfate, sulfite and soda pulp. Unbleached pulps, which are also referred to as unbleached kraft pulp, are preferably used. Said fibers can be used alone or as a mixture.

The pH of the cellulose fiber slur is, for example, from 4 to 8, preferably from 6 to 8. The draining of the paper stock can be carried out batchwise or continuously on a paper machine.

After the draining of the paper stock and the drying of the paper product, engine-sized paper products, such as paper, board or cardboard, having a basis weight of, for example, from 20 to 400 g/m$^2$, preferably from 40 to 220 g/m$^2$, are obtained.

The draining of the paper stock is preferably effected additionally in the presence of a retention aid. In addition to anionic retention aids or nonionic retention aids, such as polyacrylamides, cationic polymers are preferably used as retention aids and as drainage aids. A significant imp movement of the runability of the paper machines is achieved thereby.

Cationic retention aids which may be used are all products commercially available for this purpose. These are, for example, cationic polyacrylamides, polydiallyldimethyl-ammonium chlorides, high molecular weight polyvinylamines, high molecular weight polyvinylamines having K values of more than 150, polyethylenimines, polyamines having a molar mass of more than 50 000, modified polyamines which are grafted with ethylenimine and, if required, crosslinked, polyetheramides, polyvinylimidazoles, polyvinylpyrrolidines, polyvinylimidazolines, polyvinyltetrahydropyrines, poly(dialkylaminoalkyl vinyl ethers), poly(dialkylaminoalkyl(meth)acrylates) in protonated or in quaternized form, and polyamidoamines obtained from a dicarboxylic acid, such as adipic acid, and polyalkylenepolyamines, such as diethylenetriamine-amine, which are grafted with ethylenimine and crosslinked with polyethylene glycol dichlorohydrin ethers according to DE-B-24 34 816, or polyamidoamines which have been reacted with epichlorohydrin to give water-soluble condensates, and copolymers of acrylamide or methacrylamide and dialkylaminoethyl acrylates or methacrylates, for example copolymers of acrylamide and dimethylaminoethyl acrylate in the form of the salt with hydrochloric acid or in a form quaternized with methyl chloride. Further suitable retention aids are so-called microparticle systems comprising cationic polymers, such as cationic starch, and finely divided silica or comprising cationic polymers, such as cationic polyacrylamide, and bentonite.

The cationic polymers which are used as retention aids have, for example, Fikentscher K values of more than 150 (determined in 5% strength aqueous sodium chloride solution at a polymer concentration of 0.5% by weight, a temperature of 25° C. and a pH of 7). They are preferably used in amounts of from 0.01 to 0.3% by weight, based on dry cellulose fibers.

If necessary, further assistants, such as those known from the literature to the person skilled in the art, may be added to the paper stock prior to sheet formation. These are, for example, fixing agents, strength agents and antifoams.

The present invention furthermore relates to the use of the novel paper size as an engine size for the production of paper, board and cardboard.

The examples which follow are intended to illustrate the invention, but without limiting it.

Unless evident otherwise from the context, stated percentages in the examples are percentages by weight. The K values were determined according to H. Fikentscher, Cellulose-Chemie 13 (1932), 58-64 and 71-74, in % strength aqueous sodium chloride solution at a temperature of 25° C. and a pH of 7 at a polymer concentration of 0.5% by weight. The mean particle diameter of the dispersed particles of the polymer dispersions was determined both by Fraunhofer diffraction using a Coulter apparatus of the type LS 30 with a small volume module and by electron microscopy. The viscosities were determined using a Brookfield viscometer at a temperature of 22° C.

EXAMPLES

Ink Flotation Time

The ink flotation time (measured in minutes) is the time test ink according to DIN 53 126 requires for 50% strike-through through a test sheet.

Cobb Value

The determination was effected according to DIN 53 132 by storing the paper sheets for a period of 60 seconds in water. The water absorption is stated in g/m$^2$.

Edge Penetration

The paper sheet is laminated on both sides with an adhesive tape without strips. Strips measuring 25×75 mm are then cut out therefrom. These test strips are immersed in a 30% strength hydrogen peroxide bath at 70° C. or in a 3% strength lactic acid bath at 25° C. The edge penetration is determined by differential weighing of the dry test strips and of the test strips immersed in the bath.

Polyvinylamine 1

Cationic polymer which was obtained by hydrolysis of poly-N-vinylformamide having a K value of 50 to a degree of hydrolysis of 95 mol %, i.e. it was a polymer which comprised about 95 mol % of vinylamine units and about 5 mol % of vinylformamide units. The polymer was brought to pH 3.7 with formic acid.

Polyvinylamine 2

Cationic polymer which was obtained by hydrolysis of poly-N-vinylformamide having a K value of 45 to a degree of hydrolysis of 95 mol %, i.e. it was a polymer which comprised about 75 mol % of vinylamine units and about 25 mol % of vinylformamide units. The polymer was brought to pH 3.7 with formic acid.

Example 1

30 parts by weight of a 5% strength by weight solution of a cationic starch (starch modified with N,N-dimethylaminoethyl chloride, DS 0.1) were heated to 95° C., 5.7 parts by weight of a 5% strength by weight solution of naphthalenesulfonic acid/formaldehyde condensate sodium salt were stirred in, the mixture was mixed with 19.3 parts by weight of water, and 20 parts by weight of a melt of $C_{16}$-$C_{18}$-alkylketene dimer at a temperature of 90° C. were then added, 25 parts by weight of a 12% strength by weight aqueous solution of polyvinylamine 1 were added at 90° C. to the emulsion obtained.

The mixture was homogenized by means of a high-pressure homogenizer at 100 bar and 75° C. in two passes and was rapidly cooled with ice.

The dispersion obtained had a viscosity of 80 mPa·s (22° C.) and a mean particle size of 1.3 μm. After storage for 4 weeks at 40° C., the dispersion had a viscosity of 120 mPa·s.

Example 2

Example 1 was repeated, but first the solution of the naphthalenesulfonic acid/formaldehyde condensate sodium salt and then polyamine 1 were added to the initially taken solution of the cationic starch. The melt of the alkylketene dimer was added to the mixture.

Thereafter, emulsification was effected using a high-speed stirrer and homogenization was carried out in two passes in the high-pressure homogenizer as described.

The dispersion obtained had a viscosity of 100 mPa·s (22° C.) and a mean particle size of 1.5 μm. After storage for 4 weeks at 40° C., the dispersion had a viscosity of 180 mPa·s.

Comparative Example 3

Example 1 was repeated, but first the solution of polyvinylamine 1 and then the naphthalenesulfonic acid/formaldehyde condensate sodium salt were added to the initially taken solution of the cationic starch. The melt of the alkylketene dimer was added to the mixture.

Thereafter, emulsification was effected using a high-speed stirrer and homogenization was carried out in two passes in the high-pressure homogenizer as described.

The dispersion obtained had a viscosity of 250 mPa·s (22° C.) and a mean particle size of 2.5 μm. After storage for 4 weeks at 40° C., the dispersion had coagulated and had become solid.

Example 4

Example 1 was repeated, but 22 parts by weight of an 18% strength by weight solution of polyvinylamine 2 were used instead of polyvinylamine 1.

The dispersion obtained had a viscosity of 150 mPa·s (22° C.) and a mean particle size of 1.4 μm. After storage for 4 weeks at 40° C., the dispersion had a viscosity of 300 mPa·s.

Comparative Example 5

Example 4 was repeated, but the solution of polyvinylamine 2 was added after the homogenization and cooling.

The dispersion obtained had a viscosity of 250 mPa·s (22° C.) and a mean particle size of 2.8 μm. After storage for 4 weeks at 40° C., the dispersion had become solid.

Comparative Example 6

50 parts by weight of a 5% strength by weight solution of a cationic starch (DS 0.1) were heated to 95° C., 5.7 parts by weight of a 5% strength by weight solution of naphthalenesulfonic acid/formaldehyde condensate sodium salt were stirred in, the mixture was mixed with 24.3 parts by weight of water, and 20 parts by weight of a melt of $C_{16}$-$C_{18}$-alkylketene dimer at a temperature of 90° C. were then added and emulsification was effected using a high-speed stirrer.

The mixture was homogenized by means of a high-pressure homogenizer at 100 bar and 75° C. in two passes and was rapidly cooled with ice.

The dispersion obtained had a viscosity of 50 mPa·s (22° C.) and a mean particle size of 1.4 μm. After storage for 4 weeks at 40° C., the dispersion had a viscosity of 130 mPa·s.

Comparative Example 7

52.3 parts by weight of demineralized water were heated to 90° C., 5.7 parts by weight of a 5% strength by weight solution of naphthalenesulfonic acid/formaldehyde condensate sodium salt were stirred in and 22 parts by weight of an 18% strength by weight solution of polyvinylamine 2 were then added. 20 parts by weight of a melt of $C_{16}$-$C_{18}$-alkylketene dimer at a temperature of 9000 were added to the mixture at 90° C., and emulsification was effected using a high-speed stirrer.

The mixture was homogenized by means of a high-pressure homogenizer at 100 bar and 75° C. in two passes and was rapidly cooled with ice.

The dispersion obtained had a viscosity of 40 mPa·s (22° C.) and a mean particle size of 0.9 μm. After storage for 4 weeks at 40° C., the dispersion had a viscosity of 900 mPa·s.

Comparative examples 3 and 5 show that a stable dispersion is not obtained if the nitrogen-comprising polymer is initially taken (comparative example 3) or is added after the dispersing step (comparative example 5). Comparative examples 6 and 7 show the viscosity increase of dispersions which comprise no nitrogen-comprising polymer (comparative example 6) or no cationic starch (comparative example 7) on storage for 4 weeks at 40° C.

USE EXAMPLES

Use Example 1

The amounts stated in table 1, based in each case on dr cellulose fiber mixture, of the above dispersions, 20% by weight of calcium carbonate, 0.6% by weight of a cationic cornstarch and 0.04% by weight of a cationic polyacrylamide (Polymin® KE2020) as a retention aid were added to paper stock having a consistency of 8 g/l and comprising a completely bleached mixture of 70% of pine sulfate pulp and 30% of birch sulfate pulp and having a freeness of 35° (Schopper-Riegler). The pH of the mixtures was brought to 7. The mixtures were then processed on a Rapid-Köthen sheet former to give a sheet having a basis weight of 80 g/m$^2$. The sheet was then dried to a water content of 7% on a steam-heated drying cylinder at a temperature of 90° C. Immediately after the drying, the Cobb value of the sheets was determined. The sheets were then stored for 24 hours at 25° C. and a relative humidity of 50%. The measurements were then repeated. The results obtained are shown in table 1.

TABLE 1

| Dispersion | [% by wt.] of alkyldiketene, based on dry paper stock | Cobb 60 in g/m$^2$ immediately | Cobb 60 in g/m$^2$ after 24 h | Ink flotation time after 24 h in min |
|---|---|---|---|---|
| Example 1 | 0.9 | 32 | 24 | 50 |
| Example 2 | 0.9 | 34 | 23 | 55 |
| Comparative example 3 | 0.9 | 42 | 25 | 55 |
| Example 4 | 0.9 | 30 | 22 | 60 |
| Comparative example 5 | 0.9 | 36 | 24 | 45 |
| Comparative example 6 | 0.9 | 55 | 25 | 42 |
| Comparative example 7 | 0.9 | 35 | 25 | 49 |

Use Example 2

The amounts stated in table 2, based in each case on dry cellulose fiber mixture, of the above dispersions, 0.6% by weight of a cationic cornstarch and 0.04% by weight of a cationic polyacrylamide (Polymin® KE2020) as a retention aid were added to paper stock having a consistency of 8 g/l and comprising 100% of waste paper. The pH of the mixtures was brought to 7. The mixtures were then processed on a Rapid-Köthen sheet former to give a sheet having a basis weight of 100 g/m$^2$. The sheet was then dried to a water content of 7% on a steam-heated drying cylinder at a temperature of 90° C. The sheets were then stored for 24 hours at 25° C. and a relative humidity of 50%. The measurements were then repeated. The results obtained are shown in table 2.

TABLE 2

| Dispersion | [% by wt.] of alkyldiketene, based on dry paper stock | Cobb 60 in g/m$^2$ after 24 h | Ink flotation time after 24 h in min |
|---|---|---|---|
| Example 1 | 1.3 | 29 | 55 |
| Example 2 | 1.3 | 30 | 52 |
| Comparative example 3 | 1.3 | 36 | 45 |

TABLE 2-continued

| Dispersion | [% by wt.] of alkyldiketene, based on dry paper stock | Cobb 60 in g/m$^2$ after 24 h | Ink flotation time after 24 h in min |
|---|---|---|---|
| Example 4 | 1.3 | 30 | 53 |
| Comparative example 5 | 1.3 | 35 | 40 |
| Comparative example 6 | 1.3 | 42 | 33 |
| Comparative example 7 | 1.3 | 29 | 47 |

Use Example 3

The amounts stated in table 3, based in each case on dry cellulose fiber mixture, of the above dispersions, 20% by weight of calcium carbonate, 0.75% by weight of a cationic cornstarch and 0.04% by weight of a cationic polyacrylamide (Polymin® KE2020) as a retention aid were added to paper stock having a consistency of 8 g/l and comprising a completely bleached mixture of 70% of pine sulfate pulp and 30% of birch sulfate pulp and having a freeness of 35° (Schopper-Riegler). The pH of the mixtures was brought to 7. The mixtures were then processed on a Rapid-Köthen sheet former to give a sheet having a basis weight of 150 g/m$^2$. The sheet was then dried to a water content of 7% on a steam-heated drying cylinder at a temperature of 90° C. The sheets were then laminated on both sides with an adhesive tape without strips. Strips measuring 25×75 mm were cut out of the sheets. The test strips were in a 30% strength hydrogen peroxide bath at 70° C. The edge penetration was determined by differential weighing. The results obtained are shown in table 3.

TABLE 3

| Dispersion | [% by wt.] of alkyldiketene, based on dry paper stock | Edge penetration Peroxide in kg/m$^2$ |
|---|---|---|
| Example 1 | 2.0 | 1.25 |
| Example 2 | 2.0 | 1.30 |
| Comparative example 3 | 2.0 | 1.70 |
| Example 4 | 2.0 | 1.25 |
| Comparative example 5 | 2.0 | 1.51 |
| Comparative example 6 | 2.0 | 2.71 |
| Comparative example 7 | 2.0 | 1.75 |

We claim:

1. A paper size obtained by dispersing a reactive size comprising a) a stable aqueous dispersion of 5 to 35% by weight, based on the total weight of the dispersion, of a reactive size which is $C_{12}$ to $C_{22}$ alkylketene dimers, b) from 10 to 50% by weight, based on the reactive size, of a substantially linear polyvinylamine having a Fikenstscher K-value of from 45 to 50 and a degree of hydrolysis of from 70 to 100 mol %, c) from 3 to 20% by weight, based on the reactive size, of a cationic starch having a degree of substitution of 0.1 to 0.2, and d) an anionic dispersant wherein the paper size is prepared by a process, in which i) an aqueous solution of the cationic starch and of the ionic dispersant is initially mixed together, ii) subsequently, the reactive size and the vinylamine polymer are added in any desired sequence, and iii) the mixture obtained is subjected to dispersing, and wherein the dispersion remains in fluid form after 4 weeks at 40° C.

2. The paper size as claimed in claim 1, wherein at least 90 mol % of the basic nitrogen atoms in the vinylamine polymer have been protonated.

3. The paper size as claimed in claim 2, wherein the basic nitrogen atoms have been protonated by reaction with a carboxylic acid.

4. The paper size as claimed in claim 1, wherein the vinylamine polymer is a hydrolysis product of a homo- or copolymer of N-vinylformamide.

5. The paper size as claimed in claim 1, which contains 0.01 to 5% by weight, based on the reactive sizes of the anionic dispersant.

6. The paper size as claimed in claim 1, wherein the anionic dispersant is naphthalenesulfonic acid/formaldehyde condensate sodium salt.

7. The paper size as claimed in claim 1, wherein the polyvinalamine has a K value of 45 to 50 and a degree of hydrolysis of 95 mol %.

8. The paper size as claimed in claim 1, wherein the cationic starch is a starch modified with N,N-dimethylaminoethyl chloride.

9. The paper size as claimed in claim 1, wherein the cationic starch has a degree of substitution of 0.1.

10. A process for the production of paper, board or cardboard, comprising adding a paper size as claimed in claim 1 to a paper stock comprising an aqueous slurry of cellulose fibers, and draining the paper stock.

11. An engine size for the production of paper, board, cardboard and cardboard packaging for liquid comprising the paper size as claimed in claim 1.

* * * * *